US010249240B2

(12) United States Patent
Wang et al.

(10) Patent No.: US 10,249,240 B2
(45) Date of Patent: Apr. 2, 2019

(54) PIXEL DRIVE CIRCUIT

(71) Applicant: Wuhan China Star Optoelectronics Technology Co., Ltd., Wuhan, Hubei (CN)

(72) Inventors: Shou-Cheng Wang, Guangdong (CN); Di Zhang, Guangdong (CN)

(73) Assignee: Wuhan China Star Optoelectronics Technology Co., Ltd, Wuhan, Hubei (CN)

( * ) Notice: Subject to any disclaimer, the term of this patent is extended or adjusted under 35 U.S.C. 154(b) by 105 days.

(21) Appl. No.: 15/324,689

(22) PCT Filed: Jan. 5, 2017

(86) PCT No.: PCT/CN2017/070196
§ 371 (c)(1),
(2) Date: Jan. 7, 2017

(87) PCT Pub. No.: WO2018/094858
PCT Pub. Date: May 31, 2018

(65) Prior Publication Data

US 2018/0182296 A1 Jun. 28, 2018

(30) Foreign Application Priority Data

Nov. 22, 2016 (CN) ..... 2016 1 10506610

(51) Int. Cl.
*G09G 3/3208* (2016.01)
*G09G 3/3258* (2016.01)
*G09G 3/3266* (2016.01)

(52) U.S. Cl.
CPC ..... *G09G 3/3258* (2013.01); *G09G 3/3208* (2013.01); *G09G 3/3266* (2013.01);
(Continued)

(58) Field of Classification Search
CPC ..... G09G 3/3258; G09G 3/3266
See application file for complete search history.

(56) References Cited

U.S. PATENT DOCUMENTS 9,349,314 B2 5/2016 Park
2009/0103807 A1* 4/2009 Pan ..... G09G 3/20 382/173

(Continued)

FOREIGN PATENT DOCUMENTS

CN 2003173166 A 6/2003
CN 1917015 A 2/2007

(Continued)

*Primary Examiner* — Kevin M Nguyen
(74) *Attorney, Agent, or Firm* — Andrew C. Cheng

(57) ABSTRACT

The present invention provides a pixel drive circuit, wherein the pixel drive circuit comprises a plurality of cascading pixel drive units, and each pixel drive units comprising: a first resetting circuit is connected to a first pixel for receiving an input voltage and resetting the first pixel; a second resetting circuit is connected to a second pixel for receiving an input voltage and resetting the second pixel; a first controlling circuit is connected to the first and the second resetting circuits for receiving a reference voltage and supplying the reference voltage to the first and second resetting circuits; and a second controlling circuit is connected to the first and the second resetting circuits for receiving data voltages and supplying the data voltages to the first and the second resetting circuits to drive the first and the second pixels simultaneously.

15 Claims, 14 Drawing Sheets

(52) U.S. Cl.
CPC ..... *G09G 2310/061* (2013.01); *G09G 2320/0247* (2013.01)

(56) References Cited

U.S. PATENT DOCUMENTS

| | | | | |
|---|---|---|---|---|
| 2015/0364082 | A1 | 12/2015 | Gu | |
| 2016/0019836 | A1 | 1/2016 | Qing et al. | |
| 2016/0019844 | A1 * | 1/2016 | Yang ..... | G09G 3/3233 345/205 |

FOREIGN PATENT DOCUMENTS

| | | | |
|---|---|---|---|
| CN | 105513534 | A | 4/2016 |
| CN | 105528992 | A | 4/2016 |
| CN | 105609052 | A | 5/2016 |
| CN | 106023889 | A | 10/2016 |

* cited by examiner

PIXEL DRIVE CIRCUIT

FIELD OF THE INVENTION

The present invention relates to a technology of display, and more particularly, to a pixel drive circuit.

DESCRIPTION OF PRIOR ART

By developing and progressing high-definition display, because people pursue greater screen, higher resolution, more exciting visual effects, so development of wide viewing angle, high color gamut, high PPI (Pixels Per Inch) display technology has become the industry trend. However, pixel drive circuits of OLED (Organic Light-Emitting Diode) driving technology is current type, and requires GOA (gate on array) to supply scanning signals. Moreover, in order to have better display effect and threshold voltage compensation effect, supplying multiple signals to pixel drive circuit is required. Further, in order to achieve high uniformity picture and comfortable screen experience, 2T1C OLED pixel drive circuit has gradually withdrawn from public view. The OLED pixel drive circuit used in the market includes many functional TFT (thin-film transistor,) e.g., 6T1C/7T1C pixel drive circuit which can compensate the threshold voltage of transistor. The use of multiple transistors make the circuit design complicated and cost increased.

SUMMARY OF THE INVENTION

The present invention provides a pixel drive circuit to solve deficiencies of prior art, less TFTs are used to simplify the circuit and reduce cost.

In order to solve deficiencies of prior art described above, the present invention provides a pixel drive circuit, wherein the pixel drive circuit comprises a plurality of cascading pixel drive units, and each pixel drive units comprising:

a first resetting circuit is connected to a first pixel for receiving an input voltage and resetting the first pixel;

a second resetting circuit is connected to a second pixel for receiving an input voltage and resetting the second pixel;

a first controlling circuit is connected to the first and the second resetting circuits for receiving a reference voltage and supplying the reference voltage to the first and second resetting circuits; and a second controlling circuit is connected to the first and the second resetting circuits for receiving data voltages and supplying the data voltages to the first and the second resetting circuits to drive the first and the second pixels simultaneously;

the first controlling circuit comprises a reference controllable switch, a controlling port of the reference controllable switch receives light emission signals, a first port of the reference controllable switch receives the reference voltage and a second port of the reference controllable switch is connected to the second controlling circuit, the first and the second resetting circuits;

the first resetting circuit comprises a first, a second and a third controllable switches and a first capacitor, a first port of the first controllable switch receives input voltages, a controlling port of the first controllable switch is connected to a first port of the first capacitor, a second port of the first capacitor is connected to a second port of the reference controllable switch, the second resetting circuit and the second controlling circuit, a second port of the first controllable switch is connected to a first port of the second controllable switch and a first port of the third controllable switch, a controlling port of the second controllable switch receives first scanning signals, a second port of the second controllable switch is connected to the first port of the first capacitor and the controlling port of the first controllable switch, a controlling port of the third controllable switch receives light emission signals, a second port of the third controllable switch is connected to the anode of the first pixel, a cathode of the first pixel is connected to a ground;

the second resetting circuit comprises a fourth, a fifth and a sixth controllable switches and a second capacitor, a first port of the fourth controllable switch receives input voltages, a controlling port of the fourth controllable switch is connected to a first port of the second capacitor, a second port of the second capacitor is connected to the second port of the first capacitor, the second port of the reference controllable switch and the second controlling circuit, a second port of the fourth controllable switch is connected to a first port of the fifth controllable switch and a first port of the sixth controllable switch, a controlling port of the fifth controllable switch receives second scanning signals, a second port of the fifth controllable switch is connected to the first port of the second capacitor and the controlling port of the fourth controllable switch, a controlling port of the sixth controllable switch receives light emission signals, a second port of the sixth controllable switch is connected to the anode of the second pixel, a cathode of the second pixel is connected to a ground;

the first resetting circuit or the second resetting circuit further comprise a seventh controllable switch, a controlling port of the seventh controllable switch receives resetting signals, a first port of the seventh controllable switch receives input voltages, a second port of the seventh controllable switch is connected to the first port of the first controllable switch and the first port of the fourth controllable switch;

the first resetting circuit further comprises an eighth controllable switch, a controlling port the eighth controllable switch receives resetting signals, a first port of the eighth controllable switch receives initial signals, a second port of the eighth controllable switch is connected to the controlling port of the first controllable switch and the first port of the first capacitor;

the second resetting circuit further comprises a ninth controllable switch, a controlling port the ninth controllable switch receives resetting signals, a first port of the ninth controllable switch receives initial signals, a second port of the ninth controllable switch is connected to the controlling port of the fourth controllable switch and the first port of the second capacitor.

In order to solve deficiencies of prior art described above, the present invention provides a pixel drive circuit, wherein the pixel drive circuit comprises a plurality of cascading pixel drive units, and each pixel drive units comprising:

a first resetting circuit is connected to a first pixel for receiving an input voltage and resetting the first pixel;

a second resetting circuit is connected to a second pixel for receiving an input voltage and resetting the second pixel;

a first controlling circuit is connected to the first and the second resetting circuits for receiving a reference voltage and supplying the reference voltage to the first and second resetting circuits; and a second controlling circuit is connected to the first and the second resetting circuits for receiving data voltages and supplying the data voltages to the first and the second resetting circuits to drive the first and the second pixels simultaneously.

Wherein the first controlling circuit comprises a reference controllable switch, a controlling port of the reference controllable switch receives light emission signals, a first port of the reference controllable switch receives the reference voltage and a second port of the reference controllable switch is connected to the second controlling circuit, the first and the second resetting circuits.

Wherein the first resetting circuit comprises a first, a second and a third controllable switches and a first capacitor, a first port of the first controllable switch receives input voltages, a controlling port of the first controllable switch is connected to a first port of the first capacitor, a second port of the first capacitor is connected to a second port of the reference controllable switch, the second resetting circuit and the second controlling circuit, a second port of the first controllable switch is connected to a first port of the second controllable switch and a first port of the third controllable switch, a controlling port of the second controllable switch receives first scanning signals, a second port of the second controllable switch is connected to the first port of the first capacitor and the controlling port of the first controllable switch, a controlling port of the third controllable switch receives light emission signals, a second port of the third controllable switch is connected to the anode of the first pixel, a cathode of the first pixel connected to a ground;

the second resetting circuit comprises a fourth, a fifth and a sixth controllable switches and a second capacitor, a first port of the fourth controllable switch receives input voltages, a controlling port of the fourth controllable switch is connected to a first port of the second capacitor, a second port of the second capacitor is connected to the second port of the first capacitor, the second port of the reference controllable switch and the second controlling circuit, a second port of the fourth controllable switch is connected to a first port of the fifth controllable switch and a first port of the sixth controllable switch, a controlling port of the fifth controllable switch receives second scanning signals, a second port of the fifth controllable switch is connected to the first port of the second capacitor and the controlling port of the fourth controllable switch, a controlling port of the sixth controllable switch receives light emission signals, a second port of the sixth controllable switch is connected to the anode of the second pixel, a cathode of the second pixel is connected to a ground.

Wherein the first resetting circuit or the second resetting circuit further comprises a seventh controllable switch, a controlling port of the seventh controllable switch receives resetting signals, a first port of the seventh controllable switch receives input voltages, a second port of the seventh controllable switch is connected to the first port of the first controllable switch and the first port of the fourth controllable switch.

Wherein the first to the seventh controllable switches and the reference controllable switch are both P-type thin film transistors, and the controlling port, the first port and the second port of the first to the seventh controllable switches and the reference controllable switch correspond to a gate, a drain, and a source of the P-type thin film transistor respectively.

Wherein the first resetting circuit further comprises a seventh controllable switch, a controlling port the seventh controllable switch receives resetting signals, a first port of the seventh controllable switch receives initial signals, a second port of the seventh controllable switch is connected to the controlling port of the first controllable switch and the first port of the first capacitor;

the second resetting circuit further comprises an eighth controllable switch, a controlling port the eighth controllable switch receives resetting signals, a first port of the eighth controllable switch receives initial signals, a second port of the eighth controllable switch is connected to the controlling port of the fourth controllable switch and the first port of the second capacitor.

Wherein the first resetting circuit further comprises a ninth controllable switch, a controlling port the ninth controllable switch receives resetting signals, a first port of the ninth controllable switch is connected to the second port of the third controllable switch, a second port of the ninth controllable switch receives initial signals;

the second resetting circuit further comprises a tenth controllable switch, a controlling port the tenth controllable switch receives resetting signals, a first port of the tenth controllable switch is connected to the second port of the sixth controllable switch, a second port of the tenth controllable switch receives initial signals.

Wherein the first to the tenth controllable switches are both P-type thin film transistors, and the controlling port, the first port and the second port of the first to the tenth controllable switches correspond to a gate, a drain, and a source of the P-type thin film transistor respectively.

Wherein the second controlling circuit comprises a data controllable switch, a controlling port of the data controllable switch receives scanning resetting signals, a first port of the data controllable switch receives data voltages, a second port of the data controllable switch is connected to the second port of the first capacitor and the second port of second capacitor, the data controllable switch is a P-type thin film transistor, the controlling port, the first port and the second port of the data controllable switch correspond to the gate, the drain, and the source of the P-type thin film transistor respectively.

Wherein the second controlling circuit comprises a data controllable switch, a controlling port of the data controllable switch receives light emission signals, a first port of the data controllable switch receives data voltages, a second port of the data controllable switch is connected to the second port of the first capacitor and the second port of second capacitor, the data controllable switch is a N-type thin film transistor, the controlling port, the first port and the second port of the data controllable switch correspond to the gate, the drain, and the source of the N-type thin film transistor respectively.

The present invention can be concluded with the following advantages: the present invention is different from the prior art that the pixel drive circuit of the present invention treat a simple single rectangular pulse level-transmission single as a drive controlling signal, and combines two columns of pixel drive circuits controlled by the first and the second scanning signals, to the purpose of saving number of transistors and threshold voltage compensation in circuit, problem of pixel flicker can be avoided.

DESCRIPTION OF PREFERRED EMBODIMENT

Figure 1:
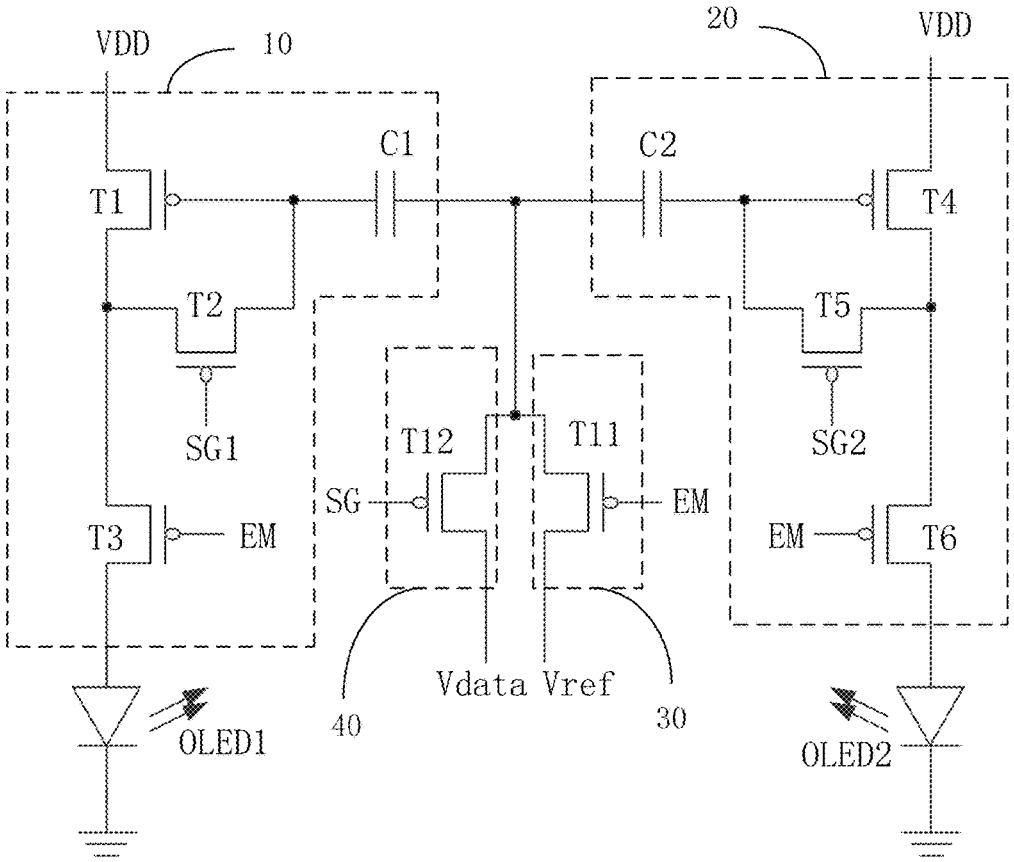
FIG. 1 is an illustrational view of a pixel drive unit of the pixel drive circuit made in accordance with the first embodiment of the present invention.
Figure 2:
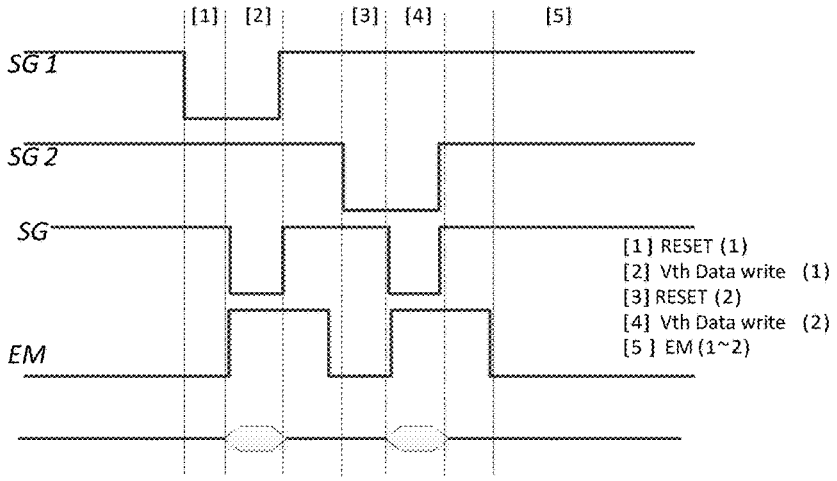
FIG. 2 is a timing waveform diagram of FIG. 1.

Referring FIGS. 1 to 4, FIG. 1 is an illustrational view of a pixel drive unit of the pixel drive circuit made in accordance with the first embodiment of the present invention. The pixel drive circuit comprises a plurality of cascading pixel drive units, and each pixel drive units comprising:

a first resetting circuit 10 is connected to a first pixel OLED1 for receiving an input voltage VDD and resetting the first pixel OLED1;

a second resetting circuit 20 is connected to a second pixel OLED2 for receiving an input voltage VDD and resetting the second pixel OLED2;

a first controlling circuit 30 is connected to the first and the second resetting circuits 10 and 20 for receiving a reference voltage Vref and supplying the reference voltage Vref to the first and second resetting circuits 10 and 20; and a second controlling circuit 40 is connected to the first and the second resetting circuits 10 and 20 for receiving data voltages Vdata and supplying the data voltages Vdata to the first and the second resetting circuits 10 and 20 to drive the first and the second pixels OLED1 and OLED2 simultaneously.

Specifically, the first controlling circuit 30 comprises a reference controllable switch T11, a controlling port of the reference controllable T11 switch receives light emission signals EM, a first port of the reference controllable switch T11 receives the reference voltage Vref and a second port of the reference controllable switch T11 is connected to the second controlling circuit 40, the first and the second resetting circuits 10 and 20.

The first resetting circuit 10 comprises a first, a second and a third controllable switches T1, T2 and T3 and a first capacitor C1, a first port of the first controllable switch T1 receives input voltages VDD, a controlling port of the first controllable switch T1 is connected to a first port of the first capacitor C1, a second port of the first capacitor C1 is connected to a second port of the reference controllable switch T11, the second resetting circuit 20 and the second controlling circuit 40, a second port of the first controllable switch T1 is connected to a first port of the second controllable switch T2 and a first port of the third controllable switch T3, a controlling port of the second controllable switch T2 receives first scanning signals SG1, a second port of the second controllable switch T2 is connected to the first port of the first capacitor C1 and the controlling port of the first controllable switch T1, a controlling port of the third controllable switch T3 receives light emission signals EM, a second port of the third controllable switch T3 is connected to the anode of the first pixel OLED1, a cathode of the first pixel OLED1 is connected to a ground;

the second resetting circuit 20 comprises a fourth, a fifth and a sixth controllable switches T4, T5 and T6, and a second capacitor C2, a first port of the fourth controllable switch T4 receives input voltages VDD, a controlling port of the fourth controllable switch T4 is connected to a first port of the second capacitor C2, a second port of the second capacitor C2 is connected to the second port of the first capacitor C1, the second port of the reference controllable switch T11 and the second controlling circuit 40, a second port of the fourth controllable switch T4 is connected to a first port of the fifth controllable switch T5 and a first port of the sixth controllable switch T6, a controlling port of the fifth controllable switch T5 receives second scanning signals SG2, a second port of the fifth controllable switch T5 is connected to the first port of the second capacitor C2 and the controlling port of the fourth controllable switch T4, a controlling port of the sixth controllable switch T6 receives light emission signals EM, a second port of the sixth controllable switch T6 is connected to the anode of the second pixel OLED2, a cathode of the second pixel OLED2 is connected to a ground.

The second controlling circuit 40 comprises a data controllable switch T12, a controlling port of the data controllable switch T12 receives scanning resetting signals SG, a first port of the data controllable switch T12 receives data voltages Vdata, a second port of the data controllable switch T12 is connected to the second port of the first capacitor C1 and the second port of second capacitor C2, the data controllable switch T12 is a P-type thin film transistor, the controlling port, the first port and the second port of the data controllable switch T12 correspond to the gate, the drain, and the source of the P-type thin film transistor respectively.

In the first embodiment, the first to the sixth controllable switches T1 to T6 and the reference controllable switch T11 are both P-type thin film transistors, and the controlling port, the first port and the second port of the first to the sixth controllable switches T1 to T6 and the reference controllable switch T11 correspond to a gate, a drain, and a source of the P-type thin film transistor respectively.

The operation principle of the first embodiment of the pixel drive circuit will be described in detail below:

Phase 1: the second and the third controllable switches T2 and T3 are turned on and the controlling port of the first controllable switch T1 is reset by discharging to prepare for writing the first threshold voltage Vth1.

Phase 2: the data controllable switch T12 and the second controllable switch T2 are both turned on, and the reference controllable switch T11 and the third controllable switch T3 are both cut off. In this moment, the first data signal Vdata1 is written to obtain the threshold voltage Vth1 of the first controllable switch T1, then the voltage across the first capacitor C1 are VDD−Vth1 and Vdata1, respectively, wherein VDD is input voltage.

Phase 3: the fifth and sixth controllable switches T5 and T6 are both turned on and the controlling port of the fourth controllable switch T4 is reset by discharging to prepare for writing the second threshold voltage Vth2.

Phase 4: the data controllable switch T12 and the fifth controllable switch T5 are both turned on, and the reference controllable switch T11 and the sixth controllable switch T6 are both cut off. In this moment, the second data signal Vdata2 is written to obtain the threshold voltage Vth2 of the fourth controllable switch T4, then the voltage across the second capacitor C2 are VDD−Vth2 and Vdata2, respectively.

Phase 5: When the light emission signal EM is at low level, because of coupling effect, the potential of the first capacitor C1 are VDD−Vth1−Vdata1+Vref and Vref, respectively; and the potential of the second capacitor C2 are VDD−Vth2−Vdata2+Vref and Vref, respectively; wherein Vref is a reference voltage, and the currents passing through the first and second pixels OLED1 and OLED2 are:

$$I\text{OLED1}=K(VGS1-V\text{th})=K(V\text{data1}-V\text{ref})^2$$

$$I\text{OLED2}=K(VGS2-V\text{th})=K(V\text{data2}-V\text{ref})^2$$

By the description above, the first and second pixels OLED1 and OLED2 are driven by the pixel drive unit simultaneously, and threshold voltage is compensated.

Figure 3:
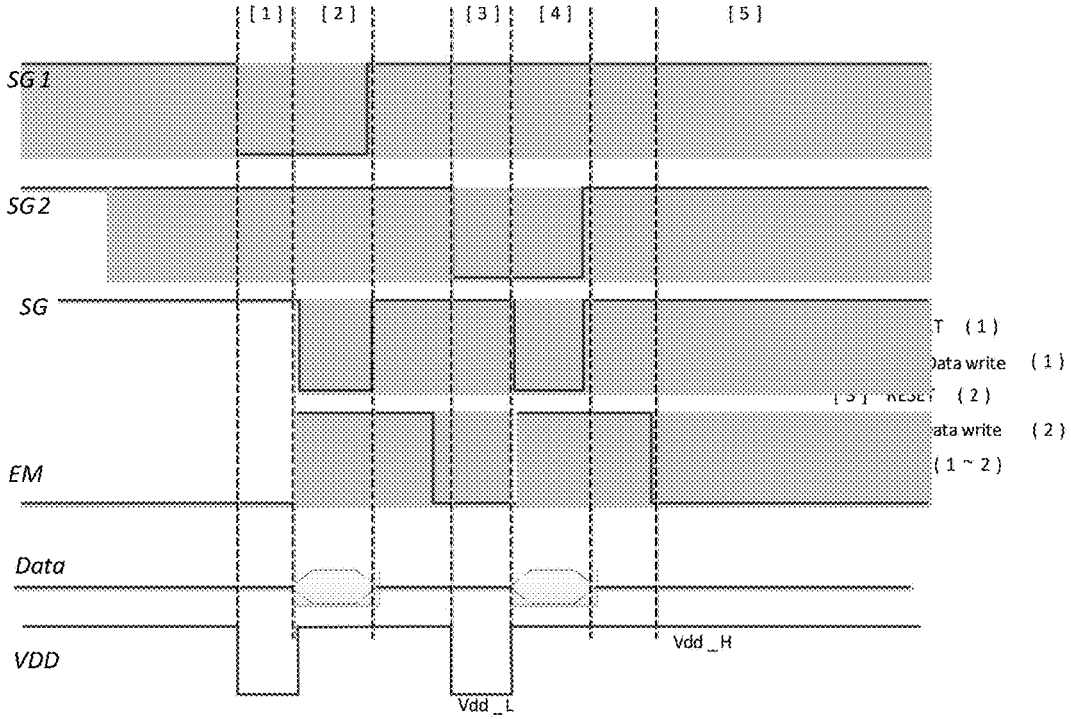
FIG. 3 is another timing waveform diagram of FIG. 1.
Figure 4:
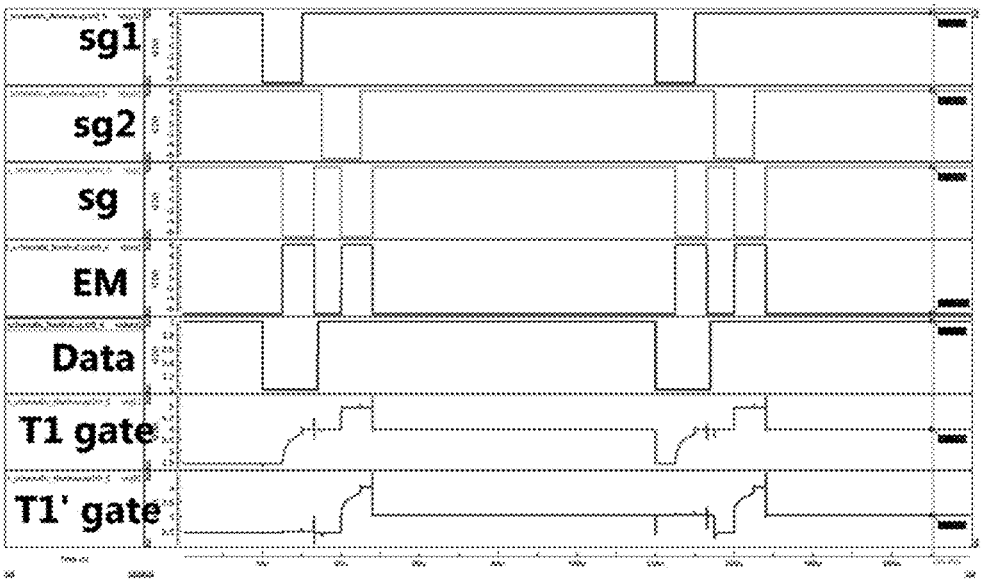
FIG. 4 is a waveform diagram of the simulation result of FIG. 1.

Referring to FIG. 3, because the controllable switches are reset, the current passing through the first and second pixels OLED1 and OLED2 is instantaneously increased to generate flickers on the screen, so the input voltage VDD uses high and low level alternating signals to prevent flicker problems.

Figure 5:
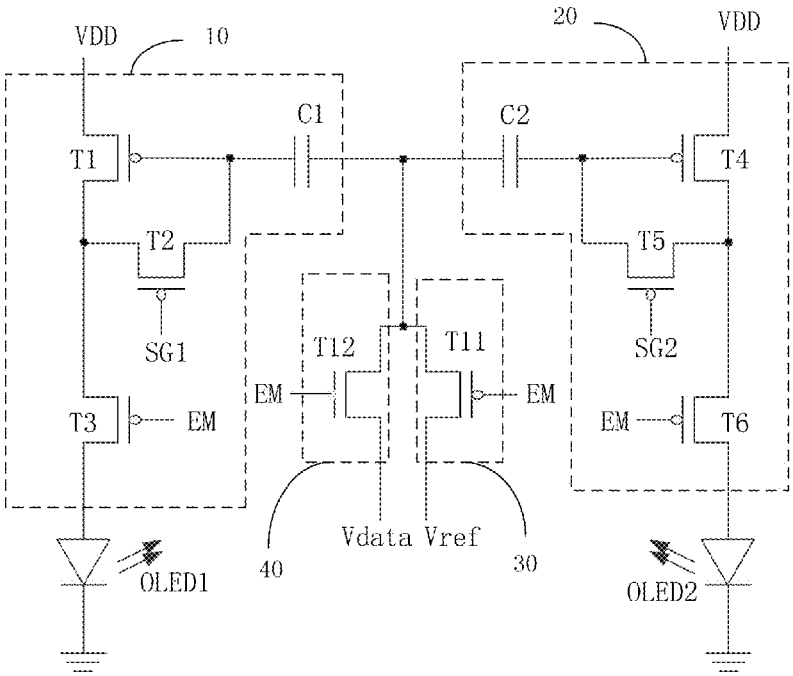
FIG. 5 is an illustrational view of a scanning drive unit of the pixel drive circuit made in accordance with the second embodiment of the present invention.
Figure 6:
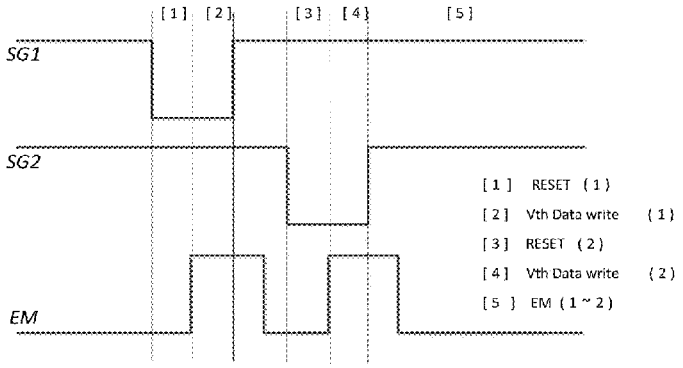
FIG. 6 is a timing waveform diagram of FIG. 5.

Referring FIGS. 5 and 6, FIG. 5 is an illustrational view of a scanning drive unit of the pixel drive circuit made in accordance with the second embodiment of the present invention. The difference between the second embodiment of the pixel drive unit and the first embodiment of the pixel drive unit is: the second controlling circuit 40 comprises a data controllable switch T12, a controlling port of the data controllable switch T12 receives light emission signals EM, a first port of the data controllable switch T12 receives data voltages Vdata, a second port of the data controllable switch T12 is connected to the second port of the first capacitor C1 and the second port of second capacitor C2, the data controllable switch T12 is a N-type thin film transistor, the controlling port, the first port and the second port of the data controllable switch T12 correspond to the gate, the drain, and the source of the N-type thin film transistor respectively.

In the second embodiment, data of pixel drive circuit can control the controlling port of the data controllable switch T12 to receive the light emission signals EM, so as to reduce the number of driving signals, and the operation principle is the same as that of the first embodiment of the pixel drive circuit, therefore no additional description is given herebelow.

Figure 7:
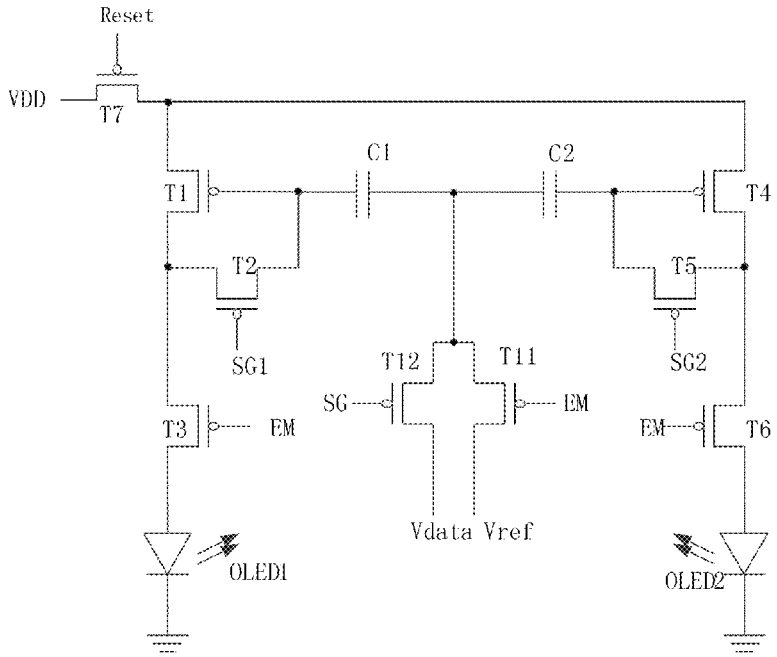
FIG. 7 is an illustrational view of a scanning drive unit of the pixel drive circuit made in accordance with the third embodiment of the present invention.
Figure 8:
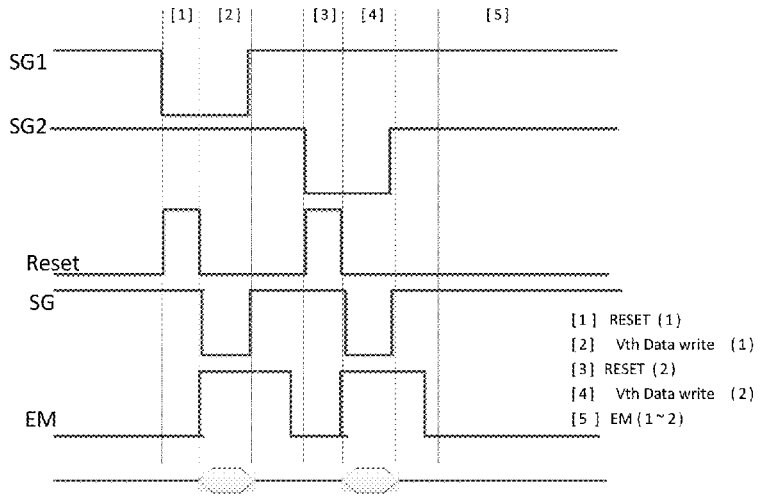
FIG. 8 is a timing waveform diagram of FIG. 7.
Figure 9:
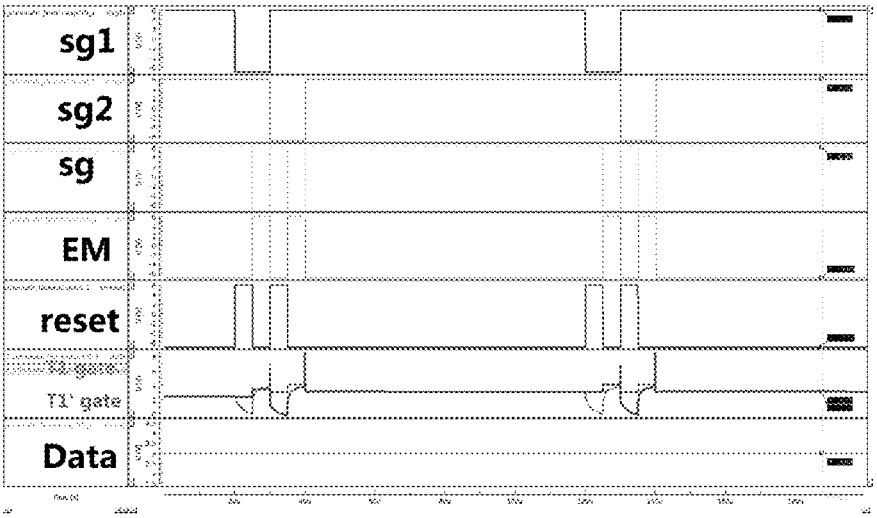
FIG. 9 is a waveform diagram of the simulation result of FIG. 7.

Referring FIGS. 7 to 9, FIG. 7 is an illustrational view of a scanning drive unit of the pixel drive circuit made in accordance with the third embodiment of the present invention. The difference between the third embodiment of the pixel drive unit and the first embodiment of the pixel drive unit is: the first resetting circuit 10 or the second resetting circuit 20 further comprises a seventh controllable switch T7, a controlling port of the seventh controllable switch T7 receives resetting signals Reset, a first port of the seventh controllable switch T7 receives input voltages VDD, a second port of the seventh controllable switch T7 is connected to the first port of the first controllable switch T1 and the first port of the fourth controllable switch T4.

In the third embodiment, the seventh controllable switch T7 is a P-type thin film transistor, the controlling port, the first port and the second port of the seventh controllable switch T7 corresponds to the gate, the drain, and the source of the P-type thin film transistor respectively.

The operation principle of the third embodiment of the pixel drive circuit will be described in detail below:

Phase 1: the second and the third controllable switches T2 and T3 are turned on, and the sixth controllable switch T6 is cut off, the controlling port of the first controllable switch T1 is reset by discharging to prepare for writing the first threshold voltage Vth1, and the input voltage VDD is cut off, the current passing through the first pixel OLED1 does not abruptly change.

Phase 2: the sixth controllable switch T6, the data controllable switch T12 and the second controllable switch T2 are both turned on, and the reference controllable switch T11 and the third controllable switch T3 are both cut off. In this moment, the data signal Vdata1 is written to obtain the threshold voltage Vth1 of the first controllable switch T1, then the voltage across the first capacitor C1 are VDD−Vth1 and Vdata1, respectively.

Phase 3: the fifth and sixth controllable switches T5 and T6 are both turned on and the sixth controllable switch T6 is cut off, the controlling port of the fourth controllable switch T4 is reset by discharging to prepare for writing the threshold voltage Vth2, the current passing through the second pixel OLED2 does not abruptly change.

Phase 4: the sixth controllable switch T6, the data controllable switch T12 and the fifth controllable switch T5 are both turned on, and the reference controllable switch T11 and the sixth controllable switch T6 are both cut off. In this moment, the data signal Vdata2 is written to obtain the threshold voltage Vth2 of the fourth controllable switch T4, then the voltage across the second capacitor C2 are VDD−Vth2 and Vdata2, respectively.

Phase 5: When the light emission signal EM is at low level, because of coupling effect, the potential of the first capacitor C1 are VDD−Vth1−Vdata1 and Vref, respectively; and the potential of the second capacitor C2 are VDD−Vth2−Vdata2+Vref and Vref, respectively; wherein Vref is a reference voltage, and the currents passing through the first and second pixels OLED1 and OLED2 are:

$$I\text{OLED1}=K(VGS1-V\text{th})=K(V\text{data1}-V\text{ref})^2$$

$$I\text{OLED2}=K(VGS2-V\text{th})=K(V\text{data2}-V\text{ref})^2$$

By the description above, the first and second pixels OLED1 and OLED2 are driven by the pixel drive unit simultaneously, and threshold voltage is compensated. Flicker problem of the first and second pixel OLED1 and OLED2 in the reset phase is avoided.

Figure 10:
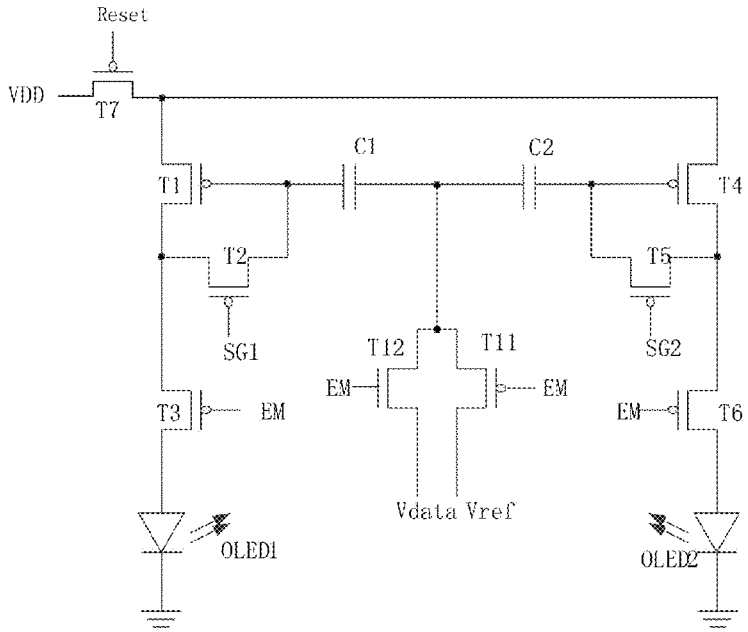
FIG. 10 is an illustrational view of a scanning drive unit of the pixel drive circuit made in accordance with the fourth embodiment of the present invention.
Figure 11:
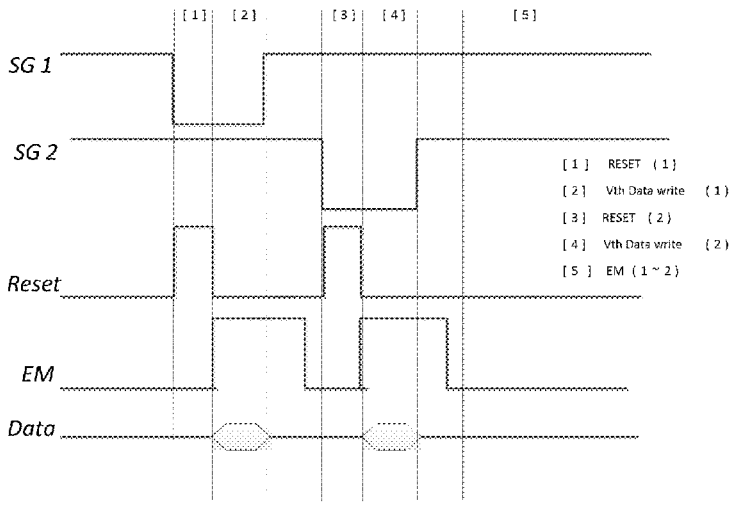
FIG. 11 is a timing waveform diagram of FIG. 10.

Referring FIGS. 10 to 11, FIG. 10 is an illustrational view of a scanning drive unit of the pixel drive circuit made in accordance with the fourth embodiment of the present invention. The difference between the fourth embodiment of the pixel drive unit and the third embodiment of the pixel drive unit is: the second controlling circuit 40 comprises a data controllable switch T12, a controlling port of the data controllable switch T12 receives light emission signals EM, a first port of the data controllable switch T12 receives data voltages Vdata, a second port of the data controllable switch T12 is connected to the second port of the first capacitor C1 and the second port of second capacitor C2, the data controllable switch T12 is a N-type thin film transistor, the controlling port, the first port and the second port of the data controllable switch T12 correspond to the gate, the drain, and the source of the N-type thin film transistor respectively.

In the fourth embodiment, data of pixel drive circuit can control the controlling port of the data controllable switch T12 to receive the light emission signals EM, so as to reduce the number of driving signals, and the operation principle is the same as that of the third embodiment of the pixel drive circuit, therefore no additional description is given herebelow.

Figure 12:
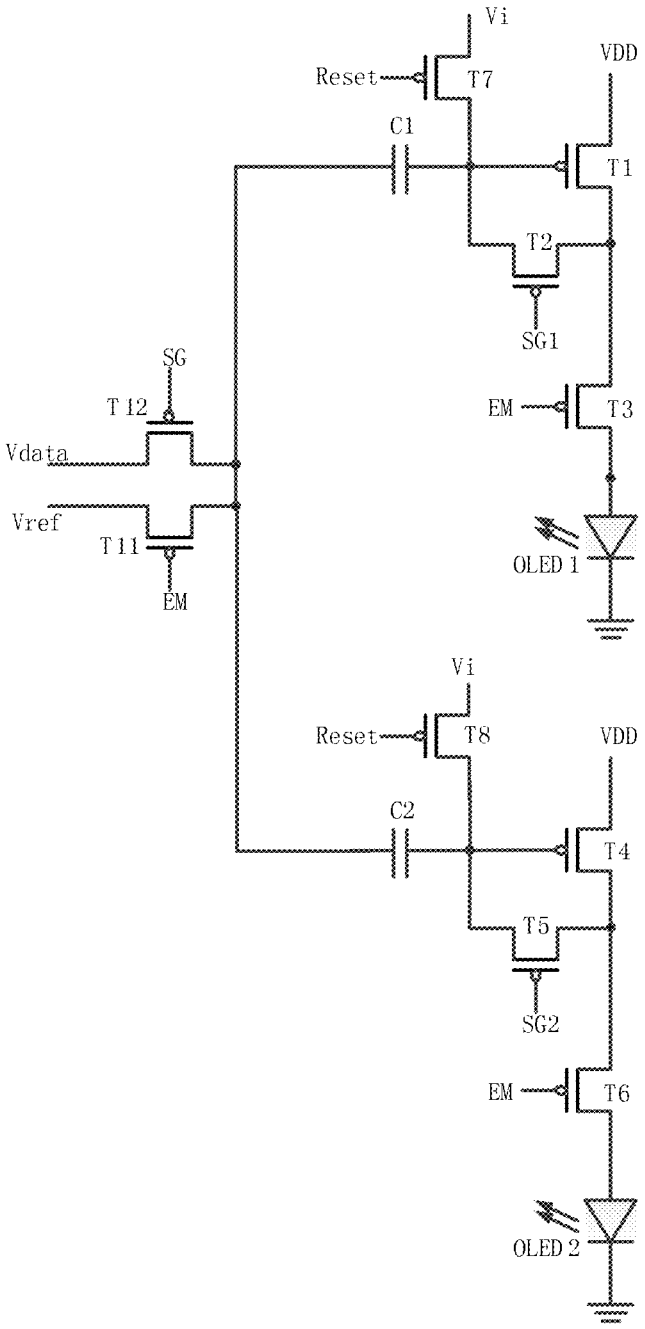
FIG. 12 is an illustrational view of a scanning drive unit of the pixel drive circuit made in accordance with the fifth embodiment of the present invention.
Figure 13:
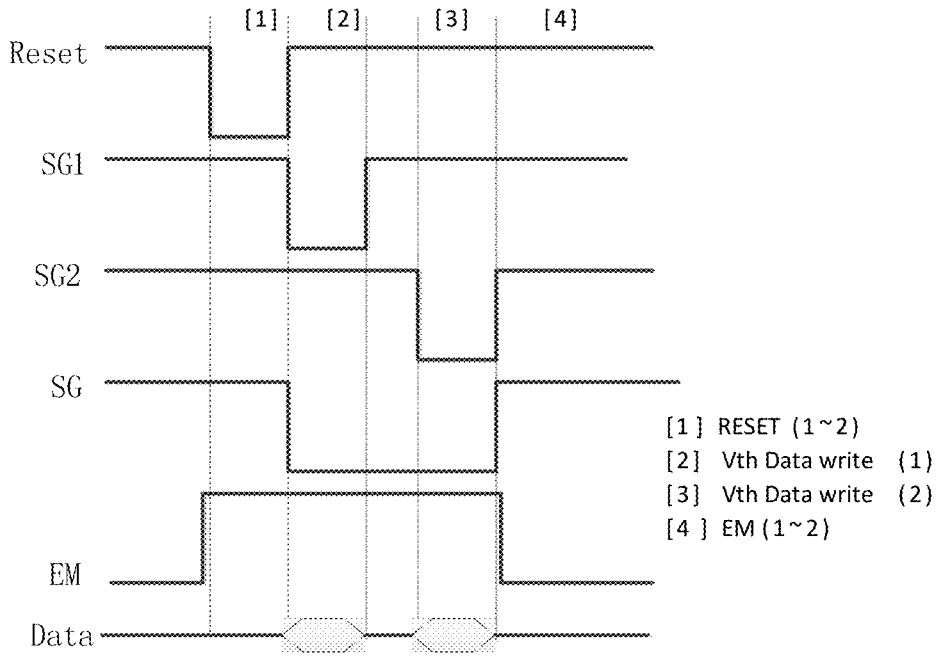
FIG. 13 is a timing waveform diagram of FIG. 12.

Referring FIGS. 12 and 13, FIG. 12 is an illustrational view of a scanning drive unit of the pixel drive circuit made in accordance with the fifth embodiment of the present invention. The difference between the fifth embodiment of the pixel drive unit and the first embodiment of the pixel drive unit is: the first resetting circuit 10 further comprises a seventh controllable switch T7, a controlling port the seventh controllable switch T7 receives resetting signals Reset, a first port of the seventh controllable switch T7 receives initial signals VI, a second port of the seventh controllable switch T7 is connected to the controlling port of the first controllable switch T1 and the first port of the first capacitor C1;

the second resetting circuit 20 further comprises an eighth controllable switch T8, a controlling port the eighth controllable switch T8 receives resetting signals Reset, a first port of the eighth controllable switch T8 receives initial signals VI, a second port of the eighth controllable switch T8 is connected to the controlling port of the fourth controllable switch T4 and the first port of the second capacitor C2.

In the fifth embodiment, the seventh and the eighth controllable switches T7 and T8 are both P-type thin film transistors, and the controlling port, the first port and the second port of the seventh and the eighth controllable switches T7 and T8 correspond to a gate, a drain, and a source of the P-type thin film transistor respectively.

The operation principle of the fifth embodiment of the pixel drive circuit will be described in detail below:

Phase 1: the seventh and the eighth controllable switches T7 and T8 are turned on, the first controllable switch T1 and the fourth controllable switch T4 are reset by initial signals VI to prepare for writing the threshold voltages Vth1 and Vth2; in this moment, the voltage across the first and the second capacitors C1 and C2 are VI and Vref, respectively.

Phase 2: the data controllable switch T12 and the second controllable switch T2 are both turned on, in this moment, the data signal Vdata1 is written to obtain the threshold voltage Vth1 of the first controllable switch T1, then the voltage across the first capacitor C1 are VDD−Vth1 and Vdata1, respectively.

Phase 3: the data controllable switch T12 and the fifth data controllable switch T5 are both turned on, in this moment, the data signal Vdata2 is written to obtain the threshold voltage Vth2 of the fourth controllable switch T4, then the voltage across the second capacitor C2 are VDD−Vth2 and Vdata2, respectively.

Phase 4: When the light emission signal EM is at low level, because of coupling effect, the potential of the first capacitor C1 are VDD−Vth1−Vdata1 and Vref, respectively; and the potential of the second capacitor C2 are VDD−Vth2−Vdata2+Vref and Vref, respectively; wherein Vref is a reference voltage, and the currents passing through the first and second pixels OLED1 and OLED2 are:

$$I\text{OLED1}=K(VGS1-V\text{th})=K(V\text{data1}-V\text{ref})^2$$

$$I\text{OLED2}=K(VGS2-V\text{th})=K(V\text{data2}-V\text{ref})^2$$

By the description above, the first and second pixels OLED1 and OLED2 are driven by the pixel drive unit simultaneously, and threshold voltage is compensated.

Figure 14:
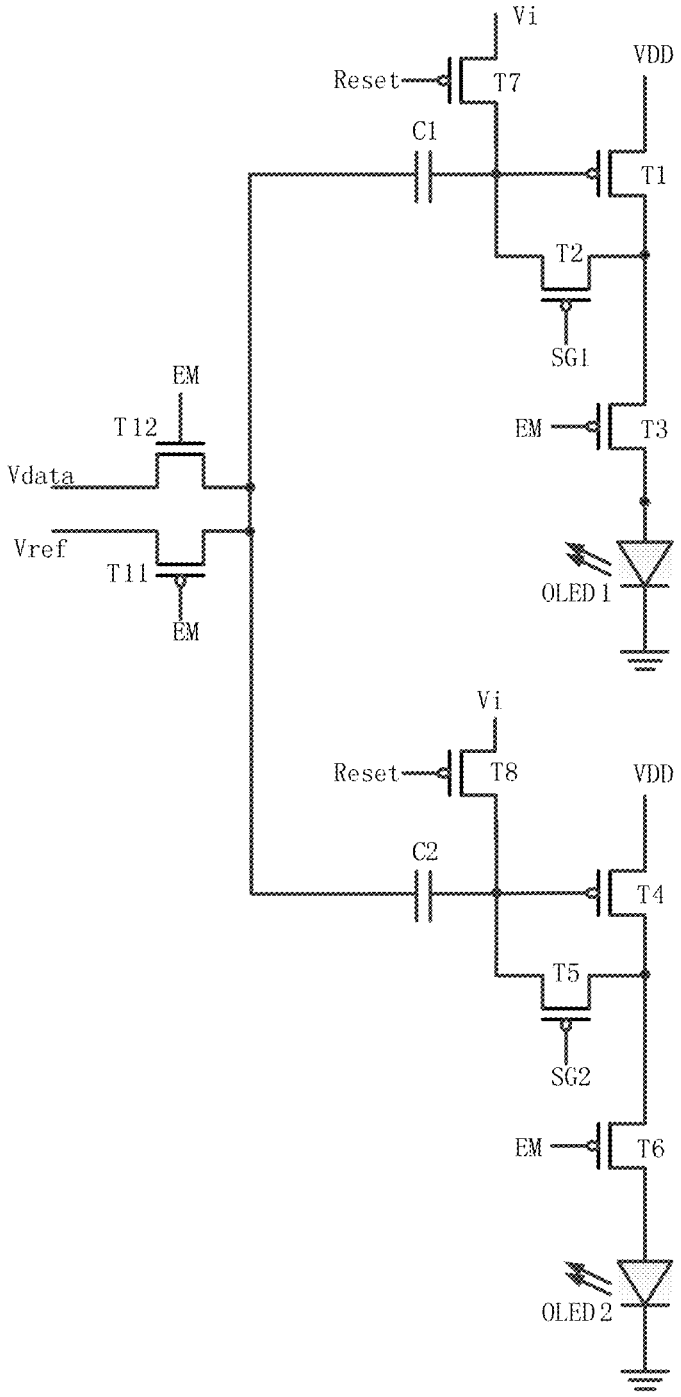
FIG. 14 is an illustrational view of a scanning drive unit of the pixel drive circuit made in accordance with the sixth embodiment of the present invention.
Figure 15:
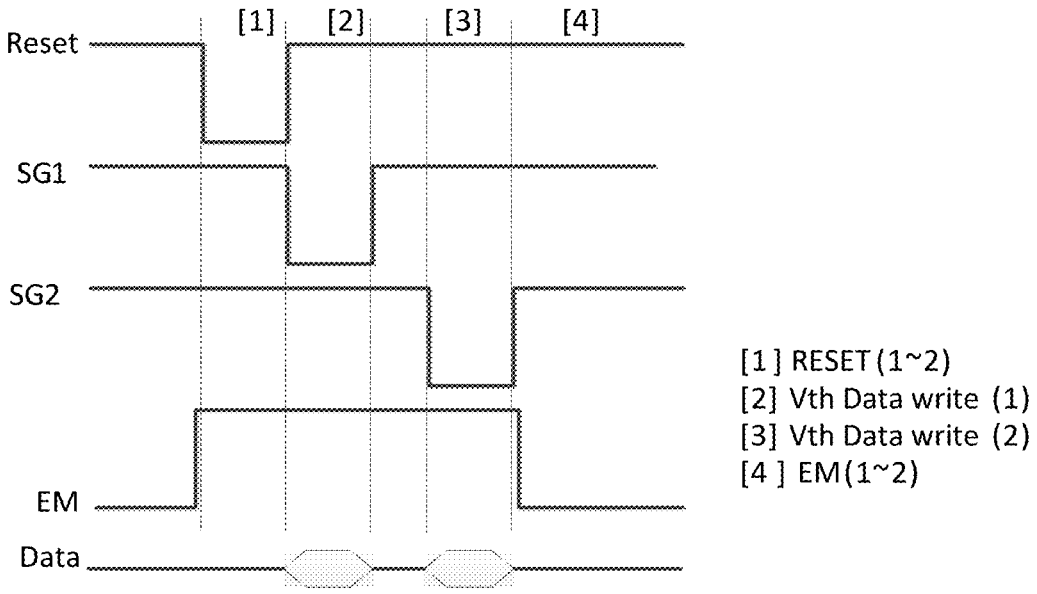
FIG. 15 is a timing waveform diagram of FIG. 14.

Referring FIGS. 14 and 15, FIG. 14 is an illustrational view of a scanning drive unit of the pixel drive circuit made in accordance with the sixth embodiment of the present invention. The difference between the sixth embodiment of the pixel drive unit and the fifth embodiment of the pixel drive unit is: the second controlling circuit 40 comprises a data controllable switch T12, a controlling port of the data controllable switch T12 receives light emission signals EM, a first port of the data controllable switch T12 receives data voltages Vdata, a second port of the data controllable switch T12 is connected to the second port of the first capacitor C1 and the second port of second capacitor C2, the data controllable switch T12 is a N-type thin film transistor, the controlling port, the first port and the second port of the data controllable switch T12 correspond to the gate, the drain, and the source of the N-type thin film transistor respectively.

In the sixth embodiment, data of pixel drive circuit can control the controlling port of the data controllable switch T12 to receive the light emission signals EM, so as to reduce the number of driving signals, and the operation principle is the same as that of the fifth embodiment of the pixel drive circuit, therefore no additional description is given herebelow.

Figure 16:
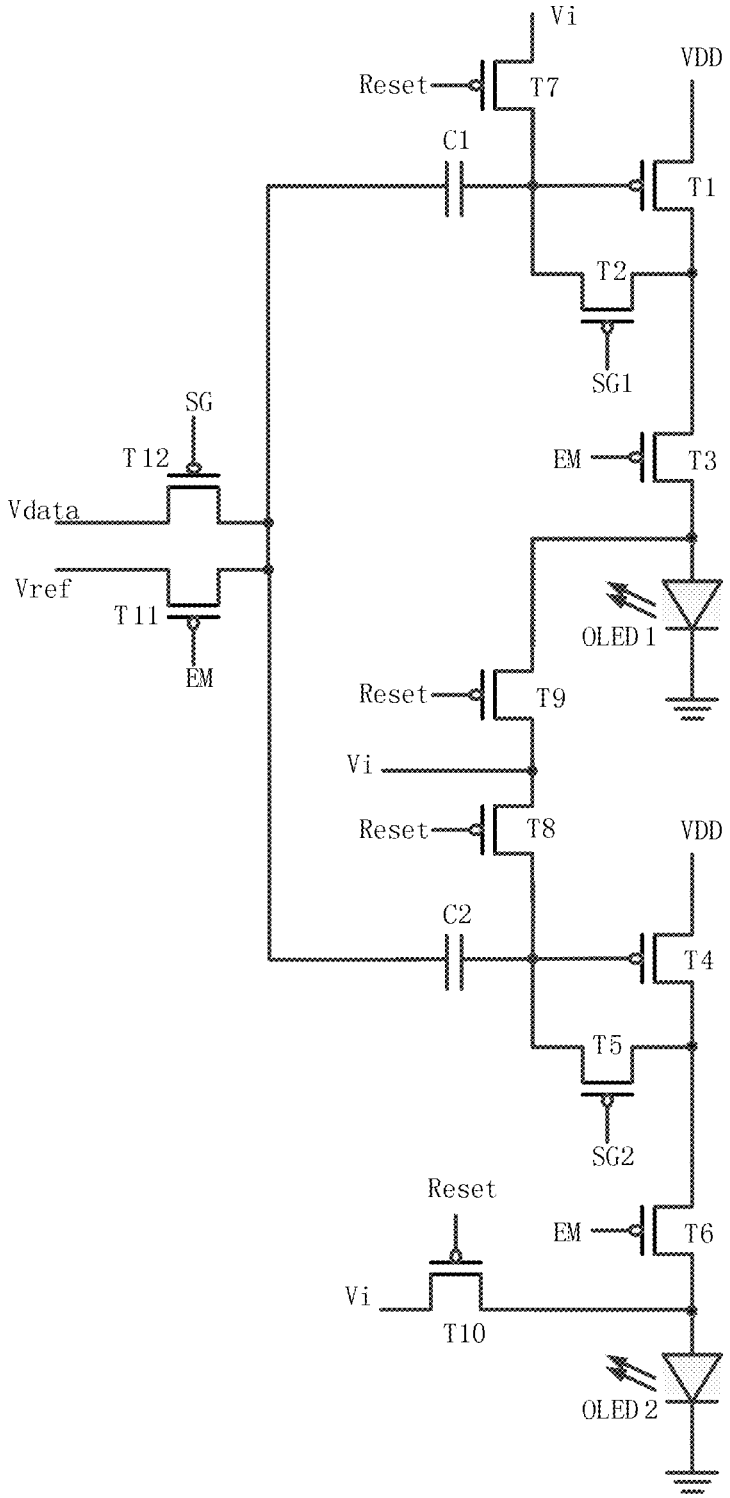
FIG. 16 is an illustrational view of a scanning drive unit of the pixel drive circuit made in accordance with the seventh embodiment of the present invention.
Figure 17:
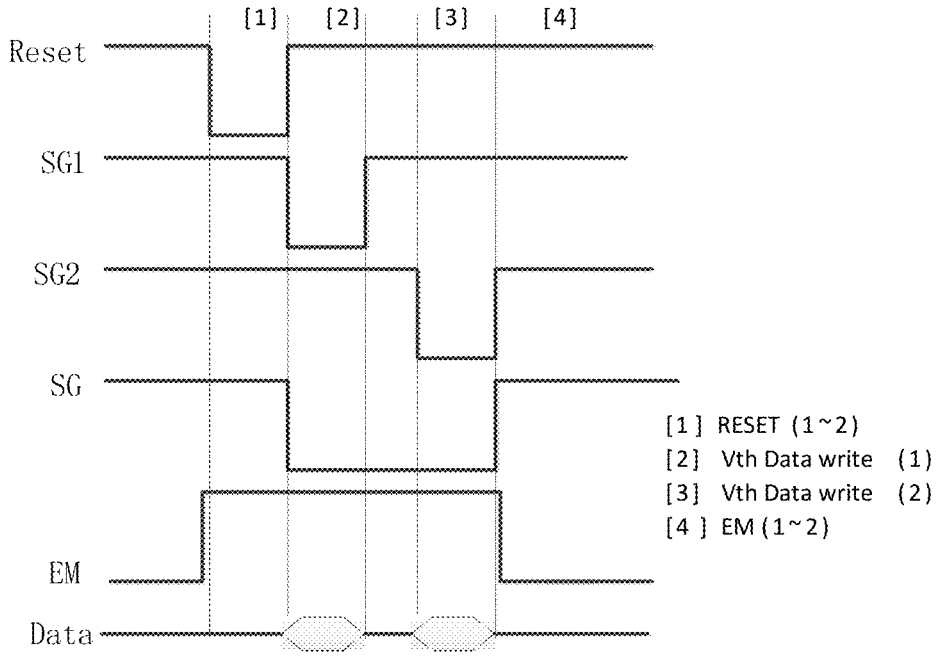
FIG. 17 is a timing waveform diagram of FIG. 16.

Referring FIGS. 16 and 17, FIG. 16 is an illustrational view of a scanning drive unit of the pixel drive circuit made in accordance with the seventh embodiment of the present invention. The difference between the seventh embodiment of the pixel drive unit and the fifth embodiment of the pixel drive unit is: the first resetting circuit 10 further comprises a ninth controllable switch T9, a controlling port the ninth controllable switch T9 receives resetting signals Reset, a first port of the ninth controllable switch T9 is connected to the second port of the third controllable switch T3, a second port of the ninth controllable switch T9 receives initial signals VI;

the second resetting circuit 20 further comprises a tenth controllable switch T10, a controlling port the tenth controllable switch T10 receives resetting signals Reset, a first port of the tenth controllable switch T10 is connected to the second port of the sixth controllable switch T6, a second port of the tenth controllable switch T10 receives initial signals VI.

In the seventh embodiment, the ninth and the tenth controllable switches T9 and T10 are both P-type thin film transistors, and the controlling port, the first port and the second port of the ninth and the tenth controllable switches T9 and T10 correspond to a gate, a drain, and a source of the P-type thin film transistor respectively.

The operation principle of the fifth embodiment of the pixel drive circuit will be described in detail below:

Phase 1: the seventh controllable switch T7, the eighth controllable switch T8, the ninth controllable switch T9 and the tenth controllable switch T10 are turned on, the first controllable switch T1 and the fourth controllable switch T4 are both reset by initial signals VI to prepare for writing the threshold voltages Vth1 and Vth2; in this moment, the voltage across the first and the second capacitors C1 and C2 are VI and Vref, respectively; and anodes of the first and second pixels OLED1 and OLED2 are reset by the ninth and tenth controllable switches T9 and T10.

Phase 2: the data controllable switch T12 and the second controllable switch T2 are both turned on, in this moment, the data signal Vdata1 is written to obtain the threshold voltage Vth1 of the first controllable switch T1, then the voltage across the first capacitor C1 are VDD−Vth1 and Vdata1, respectively.

Phase 3: the data controllable switch T12 and the fifth data controllable switch T5 are both turned on, in this moment, the data signal Vdata2 is written to obtain the threshold voltage Vth2 of the fourth controllable switch T4, then the voltage across the second capacitor C2 are VDD−Vth2 and Vdata2, respectively.

Phase 4: When the light emission signal EM is at low level, because of coupling effect, the potential of the first capacitor C1 are VDD−Vth1−Vdata1+Vref and Vref, respectively; and the potential of the second capacitor C2 are VDD−Vth2−Vdata2+Vref and Vref, respectively; the currents passing through the first and second pixels OLED1 and OLED2 are:

$$I\text{OLED1}=K(VGS1-V\text{th})=K(V\text{data1}-V\text{ref})^2$$

$$I\text{OLED2}=K(VGS2-V\text{th})=K(V\text{data2}-V\text{ref})^2$$

By the description above, the first and second pixels OLED1 and OLED2 are driven by the pixel drive unit simultaneously, and threshold voltage is compensated.

Figure 18:
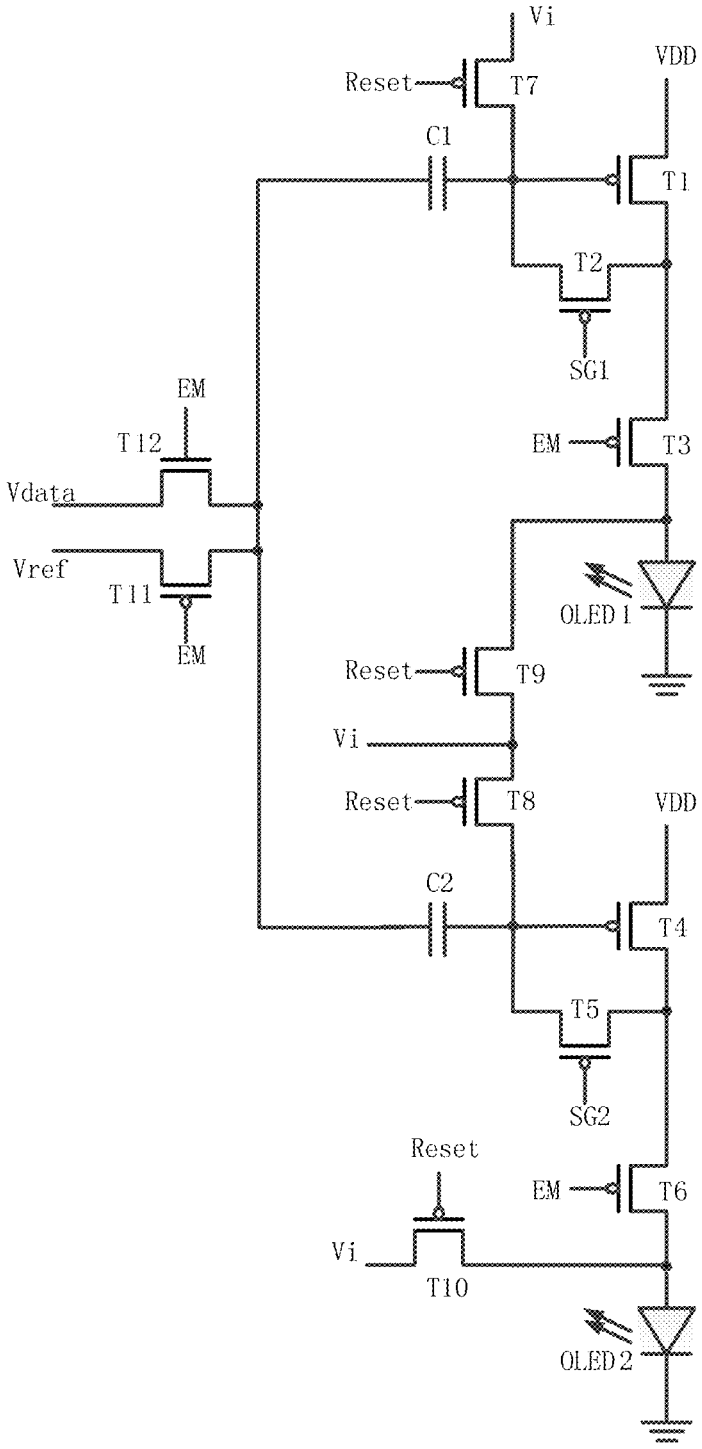
FIG. 18 is an illustrational view of a scanning drive unit of the pixel drive circuit made in accordance with the eighth embodiment of the present invention.
Figure 19:
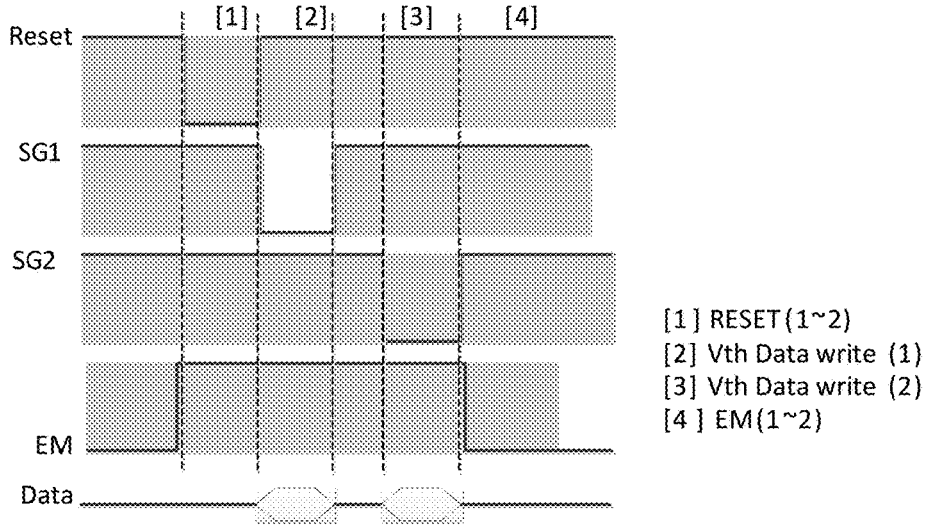
FIG. 19 is a timing waveform diagram of FIG. 18.
Figure 20:
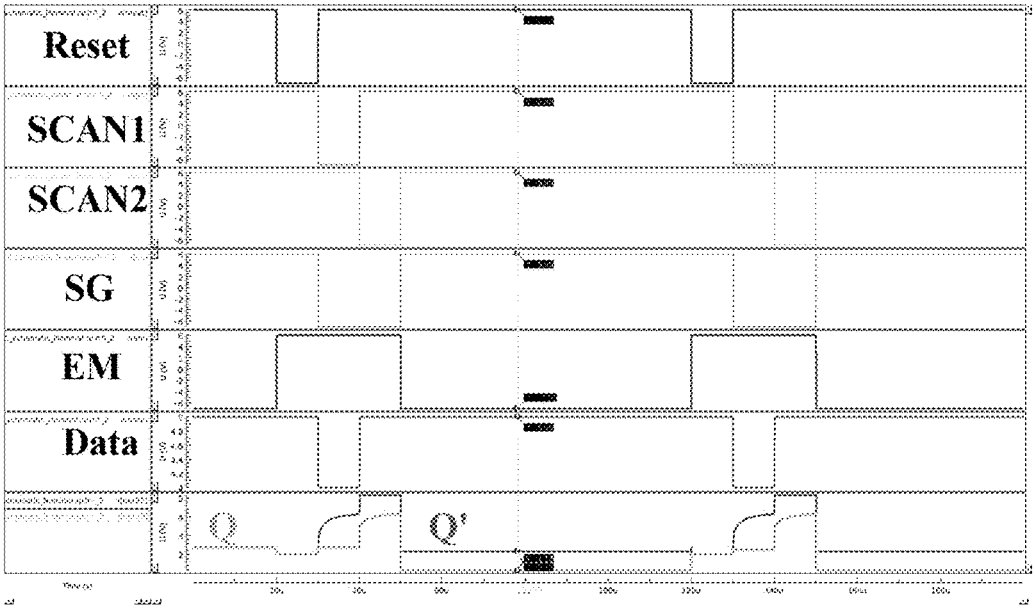
FIG. 20 is a waveform diagram of the simulation result of FIG. 18.

Referring FIGS. 18 and 20, FIG. 18 is an illustrational view of a scanning drive unit of the pixel drive circuit made in accordance with the eighth embodiment of the present invention. The difference between the eighth embodiment of the pixel drive unit and the seventh embodiment of the pixel drive unit is: the second controlling circuit 40 comprises a data controllable switch T12, a controlling port of the data controllable switch T12 receives light emission signals EM, a first port of the data controllable switch T12 receives data voltages Vdata, a second port of the data controllable switch T12 is connected to the second port of the first capacitor C1 and the second port of second capacitor C2, the data controllable switch T12 is a N-type thin film transistor, the controlling port, the first port and the second port of the data controllable switch T12 correspond to the gate, the drain, and the source of the N-type thin film transistor respectively.

In the eighth embodiment, data of pixel drive circuit can control the controlling port of the data controllable switch T12 to receive the light emission signals EM, so as to reduce the number of driving signals, and the operation principle is the same as that of the fifth embodiment of the pixel drive circuit, therefore no additional description is given herebelow.

The pixel drive circuit of the present invention treat a simple single rectangular pulse level-transmission single as a drive controlling signal, and combines two columns of pixel drive circuits controlled by the first and the second scanning signals, to the purpose of saving number of transistors and threshold voltage compensation in circuit, problem of pixel flicker can be avoided.

Embodiments of the present invention have been described, but not intending to impose any unduly constraint to the appended claims. Any modification of equivalent structure or equivalent process made according to the disclosure and drawings of the present invention, or any application thereof, directly or indirectly, to other related fields of technique, is considered encompassed in the scope of protection defined by the claims of the present invention.

The invention claimed is:

1. A pixel drive circuit, wherein the pixel drive circuit comprises a plurality of cascading pixel drive units, and each pixel drive units comprising:

a first resetting circuit connected to a first pixel for receiving an input voltage and resetting the first pixel;

a second resetting circuit connected to a second pixel for receiving an input voltage and resetting the second pixel;

a first controlling circuit connected to the first and the second resetting circuits for receiving a reference voltage and supplying the reference voltage to the first and second resetting circuits; and a second controlling circuit connected to the first and the second resetting circuits for receiving data voltages and supplying the data voltages to the first and the second resetting circuits to drive the first and the second pixels simultaneously;

the first controlling circuit comprising a reference controllable switch, a controlling port of the reference controllable switch receiving light emission signals, a first port of the reference controllable switch receiving the reference voltage and a second port of the reference controllable switch connected to the second controlling circuit, the first and the second resetting circuits;

the first resetting circuit comprising a first, a second and a third controllable switches and a first capacitor, a first port of the first controllable switch receiving input voltages, a controlling port of the first controllable switch connected to a first port of the first capacitor, a second port of the first capacitor connected to a second port of the reference controllable switch, the second resetting circuit and the second controlling circuit, a second port of the first controllable switch connected to a first port of the second controllable switch and a first port of the third controllable switch, a controlling port of the second controllable switch receiving first scanning signals, a second port of the second controllable switch connected to the first port of the first capacitor and the controlling port of the first controllable switch, a controlling port of the third controllable switch receiving light emission signals, a second port of the third controllable switch connected to the anode of the first pixel, a cathode of the first pixel connected to a ground;

the second resetting circuit comprising a fourth, a fifth and a sixth controllable switches and a second capacitor, a first port of the fourth controllable switch receiving input voltages, a controlling port of the fourth controllable switch connected to a first port of the second capacitor, a second port of the second capacitor connected to the second port of the first capacitor, the second port of the reference controllable switch and the second controlling circuit, a second port of the fourth controllable switch connected to a first port of the fifth controllable switch and a first port of the sixth controllable switch, a controlling port of the fifth controllable switch receiving second scanning signals, a second port of the fifth controllable switch connected to the first port of the second capacitor and the controlling port of the fourth controllable switch, a controlling port of the sixth controllable switch receiving light emission signals, a second port of the sixth controllable switch connected to the anode of the second pixel, a cathode of the second pixel connected to a ground;

the first resetting circuit or the second resetting circuit further comprising a seventh controllable switch, a controlling port of the seventh controllable switch receiving resetting signals, a first port of the seventh controllable switch receiving input voltages, a second port of the seventh controllable switch connected to the first port of the first controllable switch and the first port of the fourth controllable switch;

the first resetting circuit further comprising an eighth controllable switch, a controlling port the eighth controllable switch receiving resetting signals, a first port of the eighth controllable switch receiving initial signals, a second port of the eighth controllable switch connected to the controlling port of the first controllable switch and the first port of the first capacitor;

the second resetting circuit further comprising a ninth controllable switch, a controlling port the ninth controllable switch receiving resetting signals, a first port of the ninth controllable switch receiving initial signals, a second port of the ninth controllable switch connected to the controlling port of the fourth controllable switch and the first port of the second capacitor.

2. A pixel drive circuit, wherein the pixel drive circuit comprises a plurality of cascading pixel drive units, and each pixel drive units comprising:

a first resetting circuit connected to a first pixel for receiving an input voltage and resetting the first pixel;

a second resetting circuit connected to a second pixel for receiving an input voltage and resetting the second pixel;

a first controlling circuit connected to the first and the second resetting circuits for receiving a reference voltage and supplying the reference voltage to the first and second resetting circuits; and a second controlling circuit connected to the first and the second resetting circuits for receiving data voltages and supplying the data voltages to the first and the second resetting circuits to drive the first and the second pixels simultaneously;

wherein the first controlling circuit comprises a reference controllable switch, a controlling port of the reference controllable switch receiving light emission signals, a first port of the reference controllable switch receiving the reference voltage and a second port of the reference controllable switch connected to the second controlling circuit, the first and the second resetting circuits;

wherein the first resetting circuit comprises a first, a second and a third controllable switches and a first capacitor, a first port of the first controllable switch receiving input voltages, a controlling port of the first controllable switch connected to a first port of the first capacitor, a second port of the first capacitor connected to a second port of the reference controllable switch, the second resetting circuit and the second controlling circuit, a second port of the first controllable switch connected to a first port of the second controllable switch and a first port of the third controllable switch, a controlling port of the second controllable switch receiving first scanning signals, a second port of the second controllable switch connected to the first port of the first capacitor and the controlling port of the first controllable switch, a controlling port of the third controllable switch receiving light emission signals, a second port of the third controllable switch connected to the anode of the first pixel, a cathode of the first pixel connected to a ground;

the second resetting circuit comprising a fourth, a fifth and a sixth controllable switches and a second capacitor, a first port of the fourth controllable switch receiving input voltages, a controlling port of the fourth controllable switch connected to a first port of the second capacitor, a second port of the second capacitor connected to the second port of the first capacitor, the second port of the reference controllable switch and the second controlling circuit, a second port of the fourth controllable switch connected to a first port of the fifth controllable switch and a first port of the sixth controllable switch, a controlling port of the fifth controllable switch receiving second scanning signals, a second port of the fifth controllable switch connected to the first port of the second capacitor and the controlling port of the fourth controllable switch, a controlling port of the sixth controllable switch receiving light emission signals, a second port of the sixth controllable switch connected to the anode of the second pixel, a cathode of the second pixel connected to a ground.

3. The pixel drive circuit as recited in claim 2, wherein the second controlling circuit comprises a data controllable switch, a controlling port of the data controllable switch receiving scanning resetting signals, a first port of the data controllable switch receiving data voltages, a second port of the data controllable switch connected to the second port of the first capacitor and the second port of second capacitor, the data controllable switch being a P-type thin film transistor, the controlling port, the first port and the second port of the data controllable switch corresponding to the gate, the drain, and the source of the P-type thin film transistor respectively.

4. The pixel drive circuit as recited in claim 2, wherein the second controlling circuit comprises a data controllable switch, a controlling port of the data controllable switch receiving light emission signals, a first port of the data controllable switch receiving data voltages, a second port of the data controllable switch connected to the second port of the first capacitor and the second port of second capacitor, the data controllable switch being a N-type thin film transistor, the controlling port, the first port and the second port of the data controllable switch corresponding to the gate, the drain, and the source of the N-type thin film transistor respectively.

5. The pixel drive circuit as recited in claim 2, wherein the first resetting circuit or the second resetting circuit further comprises a seventh controllable switch, a controlling port of the seventh controllable switch receiving resetting signals, a first port of the seventh controllable switch receiving input voltages, a second port of the seventh controllable switch connected to the first port of the first controllable switch and the first port of the fourth controllable switch.

6. The pixel drive circuit as recited in claim 5, wherein the second controlling circuit comprises a data controllable switch, a controlling port of the data controllable switch receiving scanning resetting signals, a first port of the data controllable switch receiving data voltages, a second port of the data controllable switch connected to the second port of the first capacitor and the second port of second capacitor, the data controllable switch being a P-type thin film transistor, the controlling port, the first port and the second port of the data controllable switch corresponding to the gate, the drain, and the source of the P-type thin film transistor respectively.

7. The pixel drive circuit as recited in claim 5, wherein the second controlling circuit comprises a data controllable switch, a controlling port of the data controllable switch receiving light emission signals, a first port of the data controllable switch receiving data voltages, a second port of the data controllable switch connected to the second port of the first capacitor and the second port of second capacitor, the data controllable switch being a N-type thin film transistor, the controlling port, the first port and the second port of the data controllable switch corresponding to the gate, the drain, and the source of the N-type thin film transistor respectively.

8. The pixel drive circuit as recited in claim 5, wherein the first to the seventh controllable switches and the reference controllable switch are both P-type thin film transistors, and the controlling port, the first port and the second port of the first to the seventh controllable switches and the reference controllable switch correspond to a gate, a drain, and a source of the P-type thin film transistor respectively.

9. The pixel drive circuit as recited in claim 2, wherein the first resetting circuit further comprises a seventh controllable switch, a controlling port the seventh controllable switch receiving resetting signals, a first port of the seventh controllable switch receiving initial signals, a second port of the seventh controllable switch connected to the controlling port of the first controllable switch and the first port of the first capacitor;

and wherein the second resetting circuit further comprises an eighth controllable switch, a controlling port the eighth controllable switch receiving resetting signals, a first port of the eighth controllable switch receiving initial signals, a second port of the eighth controllable switch connected to the controlling port of the fourth controllable switch and the first port of the second capacitor.

10. The pixel drive circuit as recited in claim 9, wherein the second controlling circuit comprises a data controllable switch, a controlling port of the data controllable switch receiving scanning resetting signals, a first port of the data controllable switch receiving data voltages, a second port of the data controllable switch connected to the second port of the first capacitor and the second port of second capacitor, the data controllable switch being a P-type thin film transistor, the controlling port, the first port and the second port of the data controllable switch corresponding to the gate, the drain, and the source of the P-type thin film transistor respectively.

11. The pixel drive circuit as recited in claim 9, wherein the second controlling circuit comprises a data controllable switch, a controlling port of the data controllable switch receiving light emission signals, a first port of the data controllable switch receiving data voltages, a second port of the data controllable switch connected to the second port of the first capacitor and the second port of second capacitor, the data controllable switch being a N-type thin film transistor, the controlling port, the first port and the second port of the data controllable switch corresponding to the gate, the drain, and the source of the N-type thin film transistor respectively.

12. The pixel drive circuit as recited in claim 9, wherein the first resetting circuit further comprises a ninth controllable switch, a controlling port the ninth controllable switch receiving resetting signals, a first port of the ninth controllable switch connected to the second port of the third controllable switch, a second port of the ninth controllable switch receiving initial signals;

and wherein the second resetting circuit further comprises a tenth controllable switch, a controlling port the tenth controllable switch receiving resetting signals, a first port of the tenth controllable switch connected to the second port of the sixth controllable switch, a second port of the tenth controllable switch receiving initial signals.

13. The pixel drive circuit as recited in claim 12, wherein the first to the tenth controllable switches are both P-type thin film transistors, and the controlling port, the first port and the second port of the first to the tenth controllable switches correspond to a gate, a drain, and a source of the P-type thin film transistor respectively.

14. The pixel drive circuit as recited in claim 12, wherein the second controlling circuit comprises a data controllable switch, a controlling port of the data controllable switch receiving scanning resetting signals, a first port of the data controllable switch receiving data voltages, a second port of the data controllable switch connected to the second port of the first capacitor and the second port of second capacitor, the data controllable switch being a P-type thin film transistor, the controlling port, the first port and the second port of the data controllable switch corresponding to the gate, the drain, and the source of the P-type thin film transistor respectively.

15. The pixel drive circuit as recited in claim 12, wherein the second controlling circuit comprises a data controllable switch, a controlling port of the data controllable switch receiving light emission signals, a first port of the data controllable switch receiving data voltages, a second port of the data controllable switch connected to the second port of the first capacitor and the second port of second capacitor, the data controllable switch being a N-type thin film transistor, the controlling port, the first port and the second port of the data controllable switch corresponding to the gate, the drain, and the source of the N-type thin film transistor respectively.

* * * * *